US005234144A

United States Patent [19]

Iler

[11] Patent Number: 5,234,144

[45] Date of Patent: Aug. 10, 1993

[54] SURVIVAL CONTAINER

[76] Inventor: Gale J. Iler, 734 Norumbega Dr., Monrovia, Calif. 91016

[21] Appl. No.: 871,571

[22] Filed: Apr. 20, 1992

Related U.S. Application Data

[63] Continuation of Ser. No. 596,964, Oct. 15, 1990, abandoned.

[51] Int. Cl.[5] ..... A45F 5/00

[52] U.S. Cl. ..... 224/191; 224/202; 220/375; 220/661; 220/675; 220/756; 220/771; 441/80

[58] Field of Search ..... 224/191, 292, 205, 207; 206/522, 803, 571; 220/661, 675, 375, 304, 94 A; 441/80, 81

[56] References Cited

U.S. PATENT DOCUMENTS

| | | | |
|---|---|---|---|
| 2,138,060 | 11/1938 | Conner | 220/661 |
| 3,474,843 | 10/1969 | Maris | 220/675 |
| 3,678,611 | 7/1972 | Files | 224/202 |
| 4,523,913 | 6/1985 | Kaino | 441/81 |
| 4,861,301 | 8/1989 | Pomeroy et al. | 220/375 |
| 4,969,571 | 11/1990 | Bartz | 220/94 X |

FOREIGN PATENT DOCUMENTS

| | | | |
|---|---|---|---|
| 92333 | 6/1897 | Fed. Rep. of Germany | 441/80 |
| 328907 | 8/1936 | Italy | 441/80 |
| 34926 | 5/1922 | Norway | 220/375 |

*Primary Examiner*—Linda J. Sholl
*Attorney, Agent, or Firm*—Boniard I. Brown

[57] ABSTRACT

A survival container kit adapted for deployment in water to hold items for human survival and provide buoyant support, has strap means extending from end portions for engagement about a person, and a tubular container having an access opening intermediate its ends for access to items therein such as food, water, radio, flashlight, flares, etc.

3 Claims, 3 Drawing Sheets

SURVIVAL CONTAINER

This is a continuation of copending application Ser. No. 07/596,964 filed on Oct. 15, 1990 now abandoned.

BACKGROUND AND SUMMARY OF THE INVENTION

The present invention relates to a survival and container kit for items needed or useful in emergency situations on land or in the water. The kit can contain such items as nonperishable food, medicine, aspirin, water purification tablets, sunscreen lotion, bandages, surgical tape, compass, signal flares, matches, shark repellant, radio, whistle, can opener, knife, flashlight, etc.

The survival kit is particularly designed for use in water to buoy up a person and to supply needed items, e.g., in the event that a boat should sink or capsize, leaving the occupants in the water far from land or another boat. The survival kit may also be used in other situations, e.g., in event of an earthquake when food or medical supplies are not readily available, or in event a person becomes lost in a wilderness for several days, or in event of an aircraft crash in a wilderness area.

The survival kit of the invention preferably takes the form of an elongated tubular container having closed sealed ends. An access opening is defined in the side wall of the container about midway between the ends. The access opening is normally closed by a threaded closure cap. Items useful in an emergency situation are stored in the container, with the closure cap serving to seal the container against entry of water. Air in the container provides flotation buoyancy when the container is disposed in the water. Flexible strap means are attached to the container at axially spaced points, whereby the strap means can be extended from the container under a person's armpits and about the person's back while the person is treading water and facing the container. A person in the water can unscrew the closure cap to gain access to items in the container. The container may be constructed in various sizes. A preferred tubular container has an axial length of about thirty inches and a diameter of about seven or eight inches. The container is formed of impact-resistant polyethylene or other lightweight plastic material.

U.S. Pat. No. 4,523,913 to J. C. Kaino shows an annular safety flotation device having a "lifesaver" configuration. Four pockets are formed in one face of the device at circumferentially-spaced points thereabout. Straps retain survival items in the pockets. Apparently, none of the pockets provides a sealed space for protecting the stored items against water damage.

Devices of the present invention are deemed to have practical advantages over the device of the Kaino patent, particularly in the protection of and convenient access to the stored items. The tubular container of the present invention is designed to rest in a prone position in the water. A handle at one end of the container can be used to turn or spin the container on its longitudinal axis, to ensure that the access opening in the container faces in a direction for convenient insertion of a person's hand into the container after removal of the closure cap. The annular device of the Kaino patent will sit in the water with one flat surface thereof facing downwardly, and with its other flat surface facing upwardly. Should the downwardly-facing flat surface be the surface having the pockets therein, it will then be necessary to turn the annular device over in order to gain access to the pockets. A person floating or struggling in the water might find it quite difficult to turn the annular device over to gain access to the pockets.

DESCRIPTION OF A PREFERRED EMBODIMENT OF THE INVENTION

Figure 1:
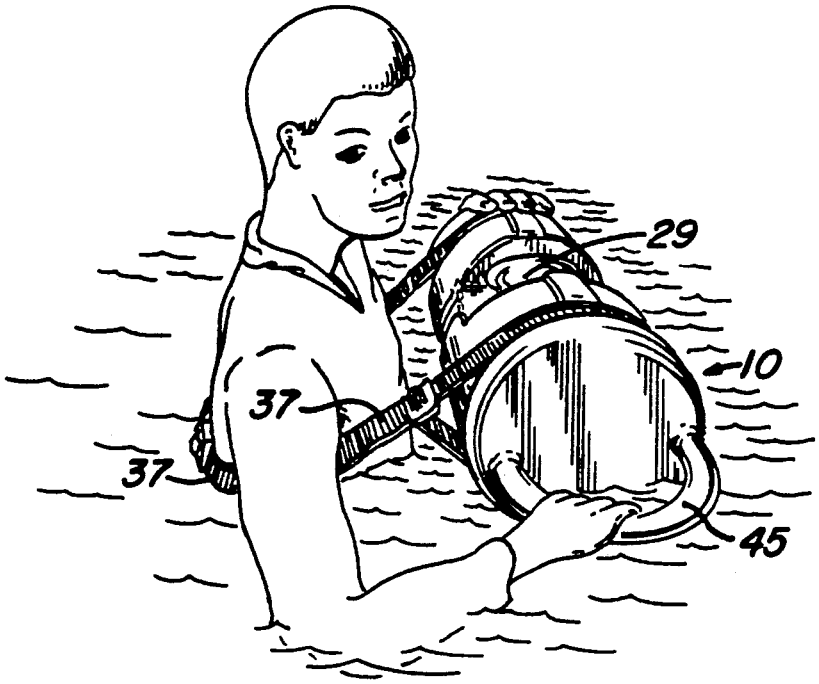
FIG. 1 is a perspective view of a survival kit embodying the invention. The kit is shown in the grasp of a person floating upright in water.

FIGS. 1 through 5 show a survival kit which includes an elongated tubular curvilinear container 10, comprising a tubular side wall 12 and two end walls 13, 15. Wall 12 is of circular cross section, as viewed in a transverse plane normal to tube axis 17.

Figure 2:
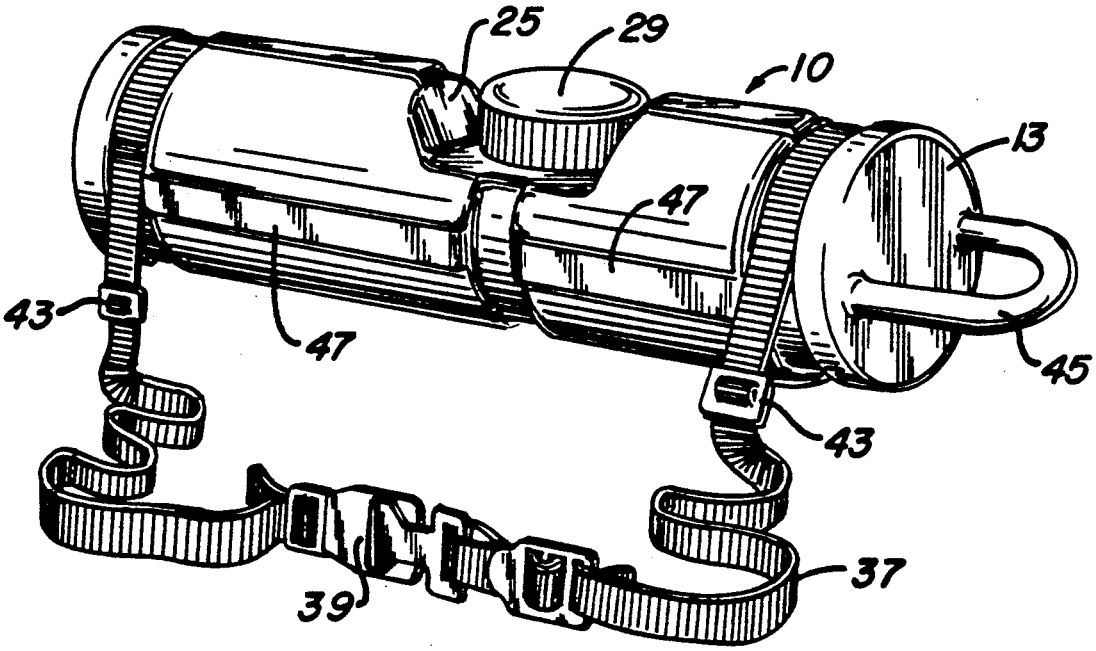
FIG. 2 is another perspective view of the survival kit of FIG. 1.
Figure 3:
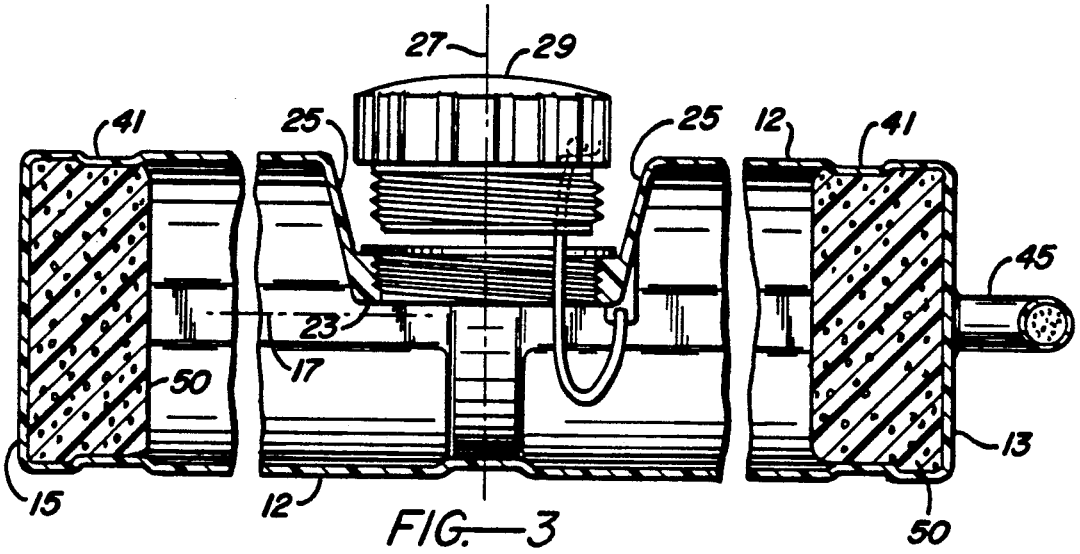
FIG. 3 is a fragmentary longitudinal sectional view of the FIG. 2 survival kit.
Figure 4:
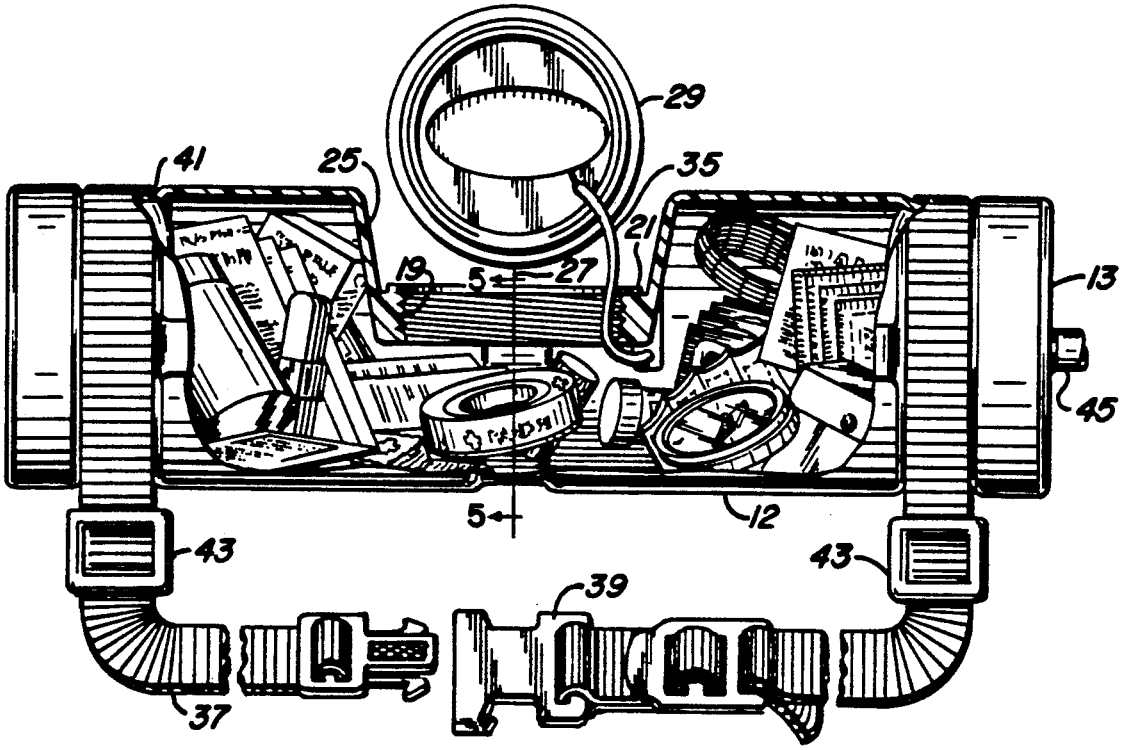
FIG. 4 is a side elevational view of the FIG. 3 structure, partially broken away to show details of an access opening and closure cap.
Figure 5:
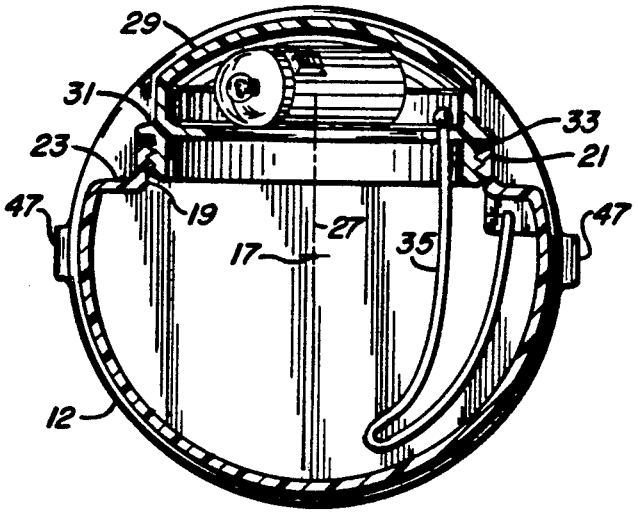
FIG. 5 is a transverse sectional view taken on line 5—5 in FIG. 4.

About midway between end walls 13 and 15 there is defined a circular access opening 19 (FIGS. 4 and 5). Hole 19 has a diameter sufficient to accommodate a person's hand, e.g., a diameter of about five inches. The diameter of tubular wall 12 may be about seven inches. Access opening 19 is defined by a cylindrical neck structure 21 extending upwardly from a chord-oriented wall 23, as seen in FIG. 5. Wall 23 is connected to tubular side wall 12 (FIG. 5) and to two segment-shaped walls 25 (FIGS. 3 and 4). The segment shape of each wall 25 is best seen in FIG. 2.

Neck structure 21 extends from surrounding wall 23, and from container axis 17 along a transverse axis 27. The internal surface of the neck structure is threaded for engagement with external threads on the side wall of an imperforate closure cap 29. The cap has a radial flange 31 located at an axially intermediate point of the cap side wall to limit the extent to which the cap can be screwed onto neck structure 21. The outer surface of the cap side wall may be serrated to facilitate turning. An elastomeric annular gasket 33 is carried on the undersurface of flange 31 for sealing engagement with the annular end edge of neck structure 21. When the cap is fully screwed into neck structure 21 gasket 33 is axially compressed to provide a liquid seal at the cap-neck structure interface. When cap 29 is unscrewed from the neck structure, it can serve as a drinking cup. A flexible cord 35 has its ends attached to cap 29 and container 10 to prevent the cap from being lost or falling out of the user's grasp.

A flexible strap means 37 is connected to side wall 12 of the container at axially spaced points in near proximity to end walls 13 and 15. The length of the strap means is such that the strap means can extend from the container under a person's armpits and around the person's back, as shown in FIG. 1. A person in the water can assume an upright floating position facing the container to gain access to closure cap 29 and access opening 19. Strap means 37 may include a buckle 39 spaced from its container attachment points. If a buckle is utilized, it should be located relatively near one of the strap attachment points so that the person can release or connect the buckle components without having to turn away from a position facing the container.

The strap means may be attached to container 10 in various ways. As shown in the drawings, the strap-attachment mechanism comprises a circumferential groove 41 in the outer surface of container side wall 12. An end section of the strap means extends about the container side wall in the circumferential groove. A friction lock member 43 is advanceable along overlapped areas of the strap means toward the container surface to enable the strap means to have a tight, non-slip fit on the container surface. As shown in FIGS. 2, 3 and 4, the two strap-attachment grooves 41 are widely spaced along the length of the container.

The strap attachment points are so oriented on the tube 12 circumference that when container 10 is partially submerged in water, as shown in FIG. 1, the closure cap 29 will be located above the water surface, with the axis 27 of neck structure 27 extending normal to the water surface. Depending on the physical characteristics of different individuals, it may be necessary temporarily to loosen lock members 43 and shift the strap means slightly relative to the container tube circumference. In most cases, the strap attachment points (lock members 43) will be located in an imaginary plane in which longitudinal axis 17 lies, and which is normal to axis 27 of neck structure 21.

When the container is initially thrown into the water, the strap means will tend to float on the water surface. Closure cap 29 may face either upwardly or downwardly. A person in the water can orient cap 29 into an upward position by turning or spinning the container about its longitudinal axis without lifting the container out of the water. A U-shaped handle 45 extends from one of the container end walls to facilitate manual turning of the container. The handle also helps to steady the container when the person is attempting to extract a survival or needed item from the container. Another steadying force is provided by four external ribs 47 which extend axially along tubular side wall 12 and parallel to container axis 17. Ribs 47 and handle 45 are disposed in an imaginary plane which contains axis 17 and is normal to axis 27 of neck structure 21. The ribs tend to stabilize the container against rotating or overturning about axis 17.

With closure cap 29 screwed onto neck structure 21 the container is buoyant in the water. Air within the container acts to maintain the container only partially submerged in the water. Buoyancy of the container is achieved partly by forming the container of low density plastic materials. Tubular member 12 may be formed of transparent plastic material, if desired, thus to minimize the search for specific survival items in the container.

Referring to FIGS. 2, 3 and 5, closure cap 29 and neck structure 21 are recessed into the circular profile of tubular side wall 12. This is advantageous in that the closure cap does not project outwardly beyond the container surface and thus cannot strike a person or act as an underwater vane to prevent rotation of the container around axis 17. Also, with a recessed neck structure, a person's hand can more easily reach into container spaces to the left or right of axis 27 (FIG. 4).

Under most circumstances, the air in container 10 will provide a desired container buoyancy. However, if any appreciable amount of water should flow into the container through opening 19, the buoyancy of the container could be compromised. To prevent such action, the container is equipped with two closed air cell structures 50 at end walls 13 and 15. As shown in FIG. 3, each cell structure comprises a block of closed cell foam material. Air trapped within the tiny cells (pores) of the foam material provides a buoyant effect to the container. Each block structure may be split to facilitate placement in the container.

Figure 6:
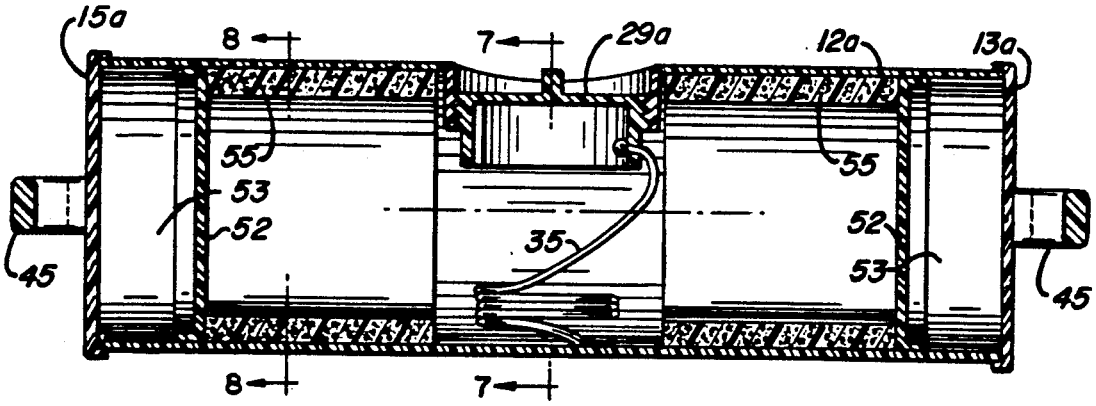
FIG. 6 is a sectional view similar to the view of FIG. 3, showing another form of the invention.
Figure 7:
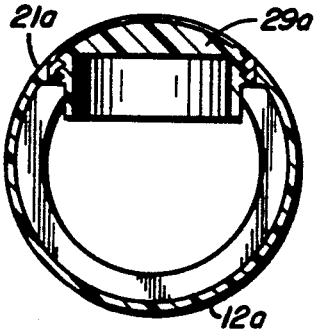
FIG. 7 is a transverse sectional view taken on line 7—7 in FIG. 6.
Figure 8:
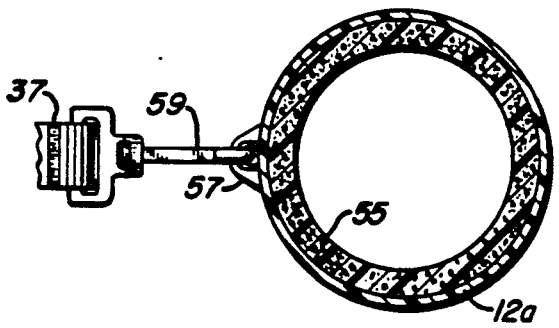
FIG. 8 is a transverse sectional view taken on line 8—8 in FIG. 6.

FIGS. 6 to 8 illustrate a second form of the invention, wherein neck structure **21*a* comprises a separate sleeve adhesively attached to tubular side wall 12*a*. The threads on cap 29*a* and on neck structure 21*a* may be pipe threads in order to achieve a sealed connection between the cap and the container. End walls 13*a* and 15*a* are formed separately from tubular side wall 12*a*. Artificial buoyancy is built into the container by providing bulkheads 52 spaced from end walls 13*a* and 15*a*. Air trapped in closed spaces 53 provides the desired buoyancy. Additional buoyancy may be provided by tubular liners 55** formed of closed cell foam material.

FIG. 8 shows a container-strap attachment means which includes an eye structure 57 attached to the container side wall. A clasp 59 extends from the strap end to hook onto the eye structure to releasably attach the strap end to the container. Each end of the strap has a clasp for attachment to eye structures at opposite ends of the container. With such an arrangement, it is not necessary to have a buckle similar to buckle 39 (FIGS. 2 and 4).

In either form of the invention, the axial length dimension of the container is preferably at least three times the diametrical dimension of the tubular side wall, whereby the container automatically assumes a prone position in the water, as shown in FIG. 1. Illustrative container dimensions are thirty inches in the axial direction, and seven inches in the diametrical direction.

Thus there has been shown and described a novel survival container which fulfills all the objects and advantages sought therefor. Many changes, modifications, variations and other uses and applications of the subject invention will, however, become apparent to those skilled in the art after considering this specification together with the accompanying drawings and claims. All such changes, modifications, variations and other uses and applications which do not depart from the spirit and scope of the invention are deemed to be covered by the invention which is limited only by the claims which follow.

The inventor claims:

1. A container for items useful in emergency and survival situations, said container comprising:

an elongated cylindrical tubular side wall having a longitudinal axis and defining an envelope, first and second end walls extending transversely of said axis for closing and sealing the ends of said tubular side wall, a single access opening means on the tubular side wall intermediate the end walls, said access opening means comprising a threaded neck structure disposed within the envelope defined by the tubular side wall, a closure cap threadedly engageable with the neck structure for removable attachment to the container, said access opening means providing manual access to items in the container when the closure cap is removed, said closure cap being disposed within the envelope defined by the tubular side wall when threadedly engaged with the neck structure, said tubular side wall having defined therein an external circumferential groove proximate to each end wall, and flexible strap means having opposite ends thereof anchored to the container at respective ones of the circumferential grooves, whereby the strap means is adapted to extend from the container under a person's armpits and about the person's back, with the person in the water and facing the container, said flexible strap means having individual end sections thereof extending within the respective circumferential grooves and about the tubular side wall to attach the strap means to the container, each end section of the strap means being adapted to be tightened or loosened in the associated groove.

2. A container for items useful in emergency and survival situations, said container comprising:

an elongated cylindrical tubular side wall having a longitudinal axis and defining an envelope, first and second end walls extending generally transversely of said axis for closing and sealing the ends of said tubular side wall, means defining a single access opening on the tubular side wall intermediate said end walls and adapted to receive thereon a closure cap, to provide manual access to items in the container when the closure cap is removed, said means defining access opening comprising two segment-shaped walls extending inwardly from the tubular side wall toward said longitudinal axis, a chord-oriented wall structure extending transversely of said axis and between said segment-shaped walls, and an internally threaded neck structure formed on the chord-oriented wall structure within the envelope defined by said tubular side wall, said neck structure having an annular edge facing away from the container longitudinal axis, and a closure cap threadedly engageable with said neck structure for removable attachment to the container, said closure cap comprising a threaded annular side wall for engagement with the threaded nut structure, and sealing means between the cap and the annular edge of the threaded neck structure, said closure cap being disposed within the envelope defined by the tubular side wall when it is threadedly engaged with the neck structure.

3. A container according to claim 2, wherein:

said closure cap comprises a threaded annular side wall having a radially extending flange and having a rim edge spaced from the flange to define a cap mouth, and further including a gasket on said flange for sealing engagement with the annular edge of the threaded neck structure.

* * * * *